US007804509B2

(12) United States Patent
Thebault et al.

(10) Patent No.: US 7,804,509 B2
(45) Date of Patent: Sep. 28, 2010

(54) METHOD AND DEVICE FOR ENCODING LUMINANCE VALUES INTO SUBFIELD CODE WORDS IN A DISPLAY DEVICE

(75) Inventors: Cédric Thebault, Villingen-Schwenningen (DE); Carlos Correa, Villingen-Schwenningen (DE); Sébastien Weitbruch, Kappel (DE)

(73) Assignee: Thomson Licensing, Boulogne-Billancourt (FR)

( * ) Notice: Subject to any disclaimer, the term of this patent is extended or adjusted under 35 U.S.C. 154(b) by 727 days.

(21) Appl. No.: 11/522,767

(22) Filed: Sep. 18, 2006

(65) Prior Publication Data

US 2007/0064019 A1 Mar. 22, 2007

(30) Foreign Application Priority Data

Sep. 22, 2005 (EP) ..... 05291973

(51) Int. Cl.
*G09G 5/10* (2006.01)

(52) U.S. Cl. ..... 345/691; 345/692

(58) Field of Classification Search ..... 345/691, 345/692

See application file for complete search history.

(56) References Cited

U.S. PATENT DOCUMENTS

| | | | | |
|---|---|---|---|---|
| 5,596,349 | A | 1/1997 | Kobayashi et al. | |
| 6,069,609 | A | 5/2000 | Ishida et al. | |
| 6,100,859 | A | 8/2000 | Kuriyama et al. | |
| 6,388,661 | B1 * | 5/2002 | Richards | 345/204 |
| 7,345,682 | B2 * | 3/2008 | Honda et al. | 345/204 |

FOREIGN PATENT DOCUMENTS

| | | |
|---|---|---|
| CN | 200510041967 | 9/2005 |
| EP | 0822536 | 2/1998 |
| EP | 0973147 | 1/2000 |
| WO | WO2005/041162 | 5/2005 |
| WO | WO2005/059879 | 6/2005 |

OTHER PUBLICATIONS

Search Report dated Feb. 17, 2006.

* cited by examiner

*Primary Examiner*—Richard Hjerpe
*Assistant Examiner*—Jeffrey Steinberg
(74) *Attorney, Agent, or Firm*—Robert D. Shedd; Harvey D. Fried; James McKenzie

(57) ABSTRACT

The invention relates to a method and a device for encoding the luminance value of a pixel of a picture into a subfield code word in a display device. It can be applied to every display device using a PWM (Pulse Width Modulation) technology and subfields for displaying video picture. It can be used to compensate for any luminance problem that can be estimated. The general idea of the recursive coding is to encode one sub-field after the other in order to be able to compensate for problems occurring on one sub-field with the other sub-fields. More particularly, the bits of a subfield code word are computed recursively one after the other such that the defects (e.g. line load and/or linearity) in the light emission or luminance generated by a bit of the subfield code word can be compensated by the following bits of the subfield code word.

10 Claims, 5 Drawing Sheets

METHOD AND DEVICE FOR ENCODING LUMINANCE VALUES INTO SUBFIELD CODE WORDS IN A DISPLAY DEVICE

This application claims the benefit, under 35 U.S.C. §119 of EP Patent Application 05291973.5, filed Sep. 22, 2005.

1. Field of the Invention

The invention relates to a method and a device for encoding the luminance value of a pixel of a picture into a subfield code word in a display device. It can be applied to every display device using a PWM (Pulse Width Modulation) technology and subfields for displaying video picture.

2. Background of the Invention

The sub-field encoding part of a display using PWM technology is one of the most important parts of the display device since the encoding is responsible of the gray-scale portrayal (linearity and level of noise dithering) and of the motion rendition (level of false contour).

The goal of the sub-field encoding is to fill up a sub-fields memory with subfields data. The subfield data of a pixel is a code word wherein each bit is representative of the state, "ON" or "OFF", of this pixel during a subfield. This subfields memory will be read during the next frame, sub-field by sub-field, whereas it is written pixel by pixel. This information is used directly to control the display device.

The subfield encoding step is generally done after a degamma function as shown in FIG. 1. The degamma function is first applied to the input luminance values. These values are then coded by the sub-field encoding step into subfield code words. The subfield encoding step is eventually preceded by a dithering step. The subfield code words are then stored in a subfields memory.

In a standard approach, the encoding step is implemented by using a simple. look-up table. A subfield code word is associated to each luminance value.

Some problems can not be solved at all or in a simple way when using this standard approach. This is the case of line load effect problem where the light emitted by a current pixel for a given luminance value can vary according to the load of the line of pixels to which the current pixel belongs. This problem can not be solved completely by using the standard approach. It is the same for the linearity problem when an average power level is controlled in the display device.

The line load effect is illustrated by FIGS. 2 and 3. The FIG. 2 shows a test picture to be displayed by a display device suffering from a problem of line load effect. The first and the last lines are black on half of the pixels, and white on the other half. The middle lines are white. The FIG. 3 shows the picture displayed by the display device. The line load effect is visible on the middle lines. This effect can be explained as follows: when a sub-field is used on a whole line its luminance is decreased by 20% compared to its luminance on a line where it is not used. The value of 20% is given as an example. The luminance value of the pixels of the middle lines is thus $255\cdot(1-(1-\frac{1}{2})\times 0.20)=229.5$ while the white pixels of the other lines have a luminance of $255\cdot(1-(1-1)\times 0.20)=255$.

SUMMARY OF THE INVENTION

It is an object of the present invention to disclose a subfield encoding method that can solve in a simple way any luminance problem and notably the line load effect problem.

So the invention concerns a method for encoding the luminance value of a pixel of a picture into a subfield code word in a display device, wherein each bit of the subfield code word has a state "ON" or "OFF" and generates light emission during an own period called subfield when its state is "ON", the light emitted for a pixel by its subfield code word being representative of the luminance value of said pixel and the total duration of the subfields associated to the bits of the subfield code word forming the picture frame. Each subfield has a weight proportional to its duration. According to the invention, the bits of each subfield code word are computed recursively in the descending order of the weights of the corresponding subfields from the bit associated to the subfield having the most significant weight to the bit associated to the subfield having the least significant weight.

More particularly, each bit of the subfield code word of a current pixel is computed by:

- for the bit associated to the subfield having the most significant weight, allocating a state "ON" to said bit if the luminance value of the current pixel is equal to or greater than a threshold value associated to said bit, and
- for each following bit of the subfield code word, computing the remaining luminance value to be encoded by said bit and the following bits of the subfield code word and allocating a state "ON" to said bit if the remaining luminance value is equal to or greater than a threshold value associated to said bit.

The threshold value associated to a bit is equal to the sum of the weights of the subfields having a lower weight than the weight of the subfield corresponding to said bit plus one.

In a specific embodiment, the remaining luminance value to be encoded by a bit for a current pixel is computed as a function of the state of the pixels of the line of the display device to which the current pixel belongs.

For example, the remaining luminance value to be encoded by a current bit of the subfield code word of a current pixel is computed by:

- calculating, for the subfield, called preceding subfield, computed just before the subfield associated to said current bit, the number of pixels having the bit associated to said preceding subfield in a "ON" state in the line of pixels to which the current pixel belongs;
- estimating a subfield luminance value for said subfield on the basis of said number of pixels, and
- subtracting said subfield luminance value from the luminance value to be encoded by the bit associated to said preceding subfield and the following bits of the subfield code word.

The invention concerns also to a device for encoding the luminance value of a pixel of a picture into a subfield code word in a display device, wherein each bit of the subfield code word has a state "ON" or "OFF" and generates light emission during an own period called subfield when its state is "ON", the light emitted for a pixel by its subfield code word being representative of the luminance value of said pixel and the total duration of the subfields associated to the bits of the subfield code word forming the picture frame. According the invention, this device computes the bits of each subfield code word recursively in the descending order of the weights of the corresponding subfields from the bit associated to the subfield having the most significant weight to the bit associated to the subfield having the least significant weight.

For computing each bit of the subfield code word of a current pixel, the device comprises:

- a comparator circuit for allocating a state "ON" to the bit associated to the subfield having the most significant weight if the luminance value of the current pixel is equal to or greater than a threshold value associated to said bit, and for allocating a state "ON" to said bit if the remaining luminance value to be encoded by said bit and the following bits of the subfield code word is equal to or greater than a threshold value associated to said bit, and a calculation circuit for calculating, for each bit of the subfield code word following the bit associated to the most significant weight subfield, the remaining luminance value to be encoded by said bit and the following bits of the subfield code word.

It further comprises a controller for outputting the threshold values associated to the different bits of the subfield code word. Threshold value associated to a bit is advantageously equal to the sum of the weights of the subfields having a lower weight than the weight of the subfield corresponding to said bit plus one.

In a preferred embodiment, the calculation circuit calculates the remaining luminance value to be encoded by a bit for a current pixel as a function of the state of the pixels of the line of the display device to which the current pixel belongs. In that case, for calculating the remaining luminance value to be encoded by a current bit of the subfield code word of a current pixel, the calculation circuit comprises:

means for calculating, for the subfield, called preceding subfield, computed just before the subfield associated to said current bit, the number of pixels having the bit associated to said preceding subfield in a "ON" state in the line of pixels to which the current pixel belongs;

means for estimating a subfield luminance value for said subfield on the basis of said number of pixels, and means for subtracting said subfield luminance value from the luminance value to be encoded by the bit associated to said preceding subfield and the following bits of the subfield code word.

The invention relates also to a PWM display device comprising an encoding device as mentioned hereinabove.

BRIEF DESCRIPTION OF THE DRAWINGS

Exemplary embodiments of the invention are illustrated in the drawings and are explained in more detail in the following description. In the drawings.

DETAILED DESCRIPTION OF PREFERRED EMBODIMENTS

Figure 1:
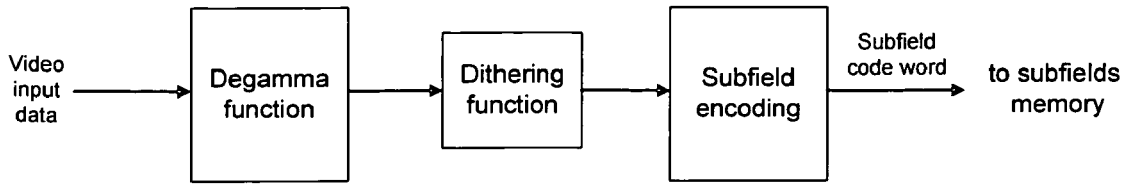
FIG. 1 is a schematic diagram showing the steps to be applied to luminance values of pixels to convert them into subfield code words.

Although the invention is described in reference to a display device suffering from a problem of line load effect when displaying some pictures, it can be used to compensate for any luminance problem that can be estimated.

The general idea of the recursive coding is to encode one sub-field after the other in order to be able to compensate for problems occurring on one sub-field with the other sub-fields. More particularly, the bits of a subfield code word are computed recursively one after the other such that the defects (e.g. line load and/or linearity) in the light emission or luminance generated by a bit of the subfield code word can be compensated by the following bits of the subfield code word. In a particular embodiment, the bits of each subfield code word will be computed recursively in the descending order of the weights of the corresponding subfields from the most significant bit (MSB) associated to the subfield having the most significant weight to the least significant bit (LSB) associated to the subfield having the least significant weight.

According to the invention, a state "1" (="ON") is allocated to the MSB of a current pixel if the luminance value of this pixel is equal to or greater than a threshold associated to this bit (or to the corresponding subfield). For each following bit, a remaining luminance value to be encoded by said bit and the following bits is computed and a state "1" is allocated to said bit if the remaining luminance value is equal to or greater than a threshold value associated to said bit.

An example will be described with the following sub-field weights and the corresponding switching values:

| | Subfield $SF_i$ | | | | | | | | | |
|---|---|---|---|---|---|---|---|---|---|---|
| | $SF_1$ | $SF_2$ | $SF_3$ | $SF_4$ | $SF_5$ | $SF_6$ | $SF_7$ | $SF_8$ | $SF_9$ | $SF_{10}$ |
| Weight $W_i$ | 1 | 2 | 4 | 7 | 12 | 19 | 29 | 42 | 59 | 80 |
| Switching value $SV_i$ | 1 | 2 | 4 | 8 | 15 | 27 | 46 | 75 | 117 | 176 |

The switching value $SV_i$ of a current subfield $SF_i$ (or of a bit of a subfield code word) is for example the sum of the weights $W_j$ of the subfields preceding said current subfields plus one:

$$SV_i = \left(\sum_{j=1}^{i-1} W_j\right) + 1$$

The remaining luminance value to be encoded by a current bit of a subfield code word of a current pixel can be computed by:

estimating the luminance generated by the bit preceding the current bit and subtracting said luminance value from the luminance value to be encoded by the bit preceding the current bit and the bits following said preceding bit.

As each bit of a subfield code word refers to a particular subfield among the plurality of subfields of the video frame, we will use indifferently in the following specification the expressions "luminance of a bit" or "luminance of a subfield". The luminance of a bit for a current pixel is calculated on the basis of the number of pixels having the preceding bit in the state "1" in the line of pixels to which the current pixel belongs.

As explained previously, the luminance of a subfield can vary depending on the line load of the line of pixels to be displayed (number of pixels in a "ON" state in the considered line of pixels). So it is evaluated as soon as all required information is known. It can be evaluated at the end of the loading of the picture but in order to limit the time delay, it usually will be evaluated at the latest after each line. For a perfect display where the luminance of a sub-field on a pixel is only a function of the pixel itself and the luminance of the pixel can be evaluated directly, the luminance of the sub-field is roughly the same for all pixels of the picture. For a display where the luminance on a line is dependent on the load distribution on this line (e.g. line load effect), the luminance of a sub-field can only be evaluated when the sub-field has been encoded for the whole line.

According to the invention, the problem of line load effect is processed in a new way. Generally, the line-load effect is seen as a luminance loss on a line. Nevertheless it is equivalent to say that when a sub-field is used on a whole line its luminance is decreased by 20% in comparison to its luminance on a line where it is not used and to say that when the sub-field is not used on a line its luminance is increased by 25% compared to its luminance when it is used on the whole line. The reference luminance is different, but the effect is the same. Thus, in the FIGS. 2 and 3, the luminance value of the pixels of the first and last lines is $255\cdot(1+(1\frac{1}{2})\times0.25)=287$ while the white pixels of the middle lines have a luminance of $255\cdot(1+(1-\frac{1}{2})\times0.25)=255$.

It has to be noted that since the luminance of each sub-field is evaluated, the linearity problem due to the APL control can also be compensated by the inventive method.

This inventive method will be better explained by means of an example using the sub-field weights and the switching values given in the previous table.

The recursive encoding method is done line by line and sub-field by sub-field. The goal is to determine for each pixel value an appropriate subfield code word. At the beginning of the method, the subfield code word of all the pixel values can be represented like this: X X X X X X X X X X.

First line: the luminance value of the white pixels (value to encode: 255) is encoded in X X X X X X X X X X;

First line: the luminance value of the black pixels (value to encode: 0) is encoded in X X X X X X X X X X;

Middle line: the luminance value of the pixels (value to encode: 255) is encoded in X X X X X X X X X X;

Last line: the luminance value of the white pixels (value to encode: 255) is encoded in X X X X X X X X X X;

Last line: the luminance value of the black pixels (value to encode: 0) is encoded in X X X X X X X X X X;

According to the invention, the bit of the subfield code word corresponding to the most significant subfield ($10^{th}$ subfield) is determined for all the pixels of the picture. On the first line and during the first recursive step (encoding of the bit related to the $10^{th}$ sub-field) the white pixels, with an original luminance value of 255, will use the sub-field 10 since $255\geqq176$ (switching value for the $10^{th}$ subfield). Therefore, their subfield code word will be of the type of X X X X X X X X X 1. The black pixels will not use this sub-field since $0<176$, so their subfield code word will be of the type of X X X X X X X X X 0.

Figure 2:
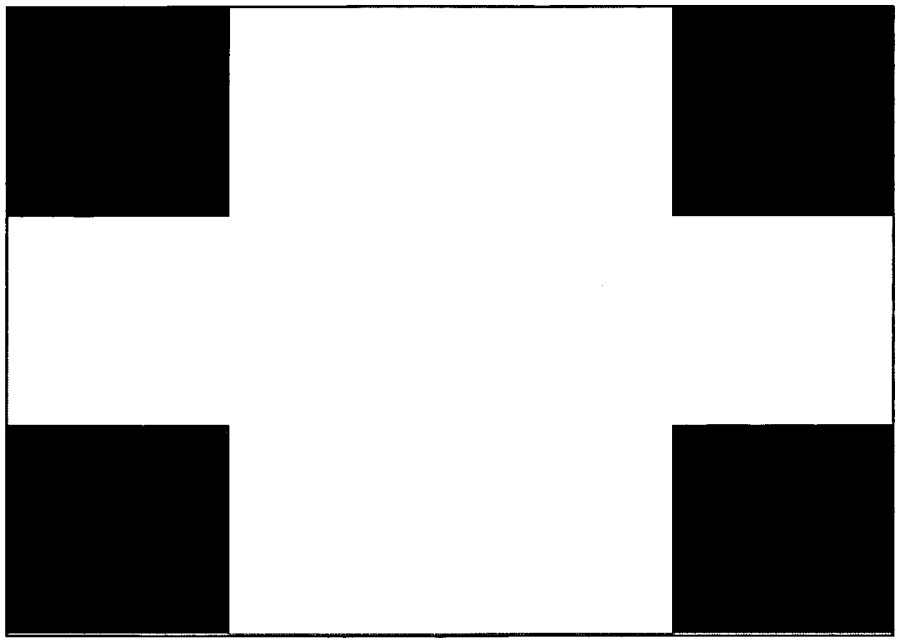
FIG. 2 is a test picture to be encoded with the inventive method.
Figure 3:
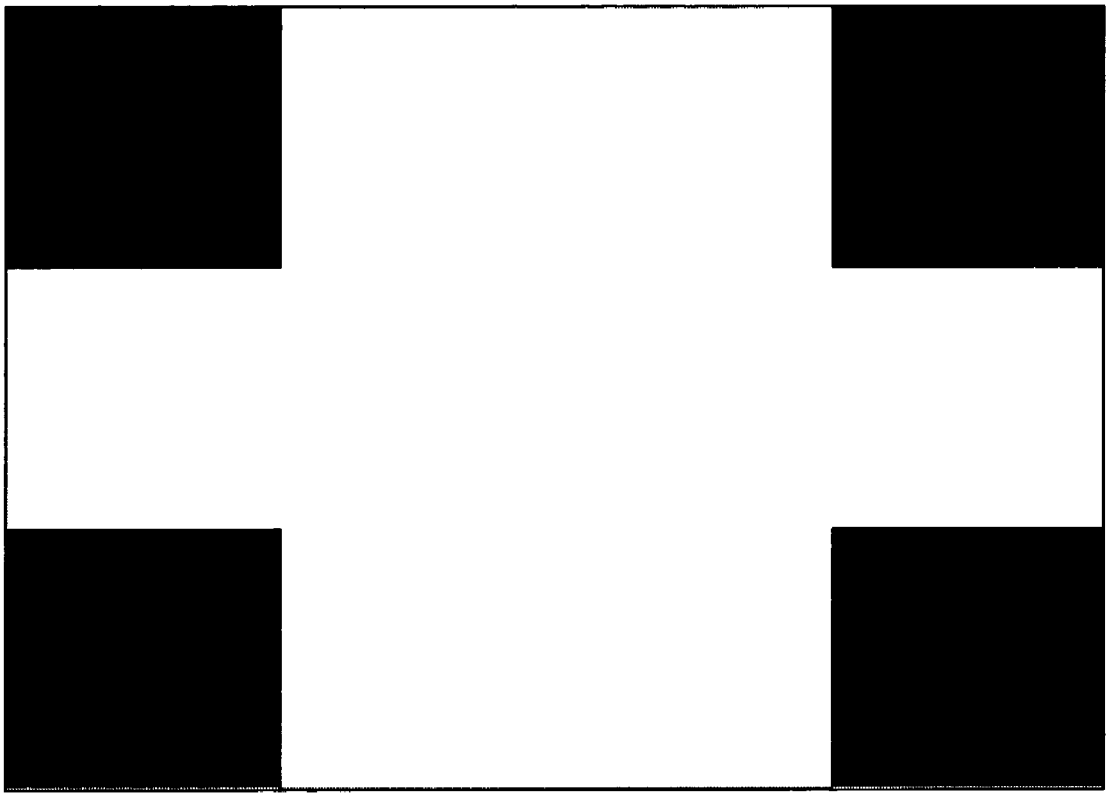
FIG. 3 illustrates the line load effect for the test picture of FIG. 2.

Once this subfield code bit has been determined for this line, its load can be evaluated and its effective luminance can be estimated. In the example of FIG. 2, the load of this line for this sub-field is equal to ½ since one half of the pixels are white and use this sub-field, and the other half is black and so do not use this sub-field. The sub-field will be brighter than expected and its luminance on this line will be equal to: $80\cdot(1+(1-\frac{1}{2})\times0.25)=90$. For the pixels where this sub-field is used, the luminance of this sub-field is subtracted to the luminance value to encode. So at the end of the first recursive step for the first line, we have:

First line: the luminance value of the white pixels is encoded in X X X X X X X X X 1; the remaining value to encode is 165;

First line, the luminance value of the black pixels is encoded in X X X X X X X X X 0 ; the remaining value to encode is 0;

For the first line, the second recursive step corresponding to the encoding of the $9^{th}$ sub-field (the most significant remaining sub-field) is carried out. The white pixels have now a luminance value of 165, so they will use the $9^{th}$ sub-field since $165\geqq117$. The black pixels will not use the $9^{th}$ sub-field since $0<117$. The load of this line for this sub-field is equal to ½. The effective luminance of the $9^{th}$ sub-field for this first line is equal to: $59\cdot(1+(1-\frac{1}{2})\times0.25)=66$. So at the end of the second recursive step on the first line we have:

First line: the luminance value of the white pixels is encoded in X X X X X X X X 1 1; the remaining value to encode is 99;

First line: the luminance value of the black pixels is encoded in X X X X X X X X 0 0; the remaining value to encode is 0;

For the first line, the third recursive step corresponding to the encoding of the $8^{th}$ sub-field is then carried out. The white pixels will use the $8^{th}$ sub-field since $99\geqq75$. The effective luminance of this sub-field for the first line is equal to $42\cdot(1+(1-\frac{1}{2})\times0.25)=47$. So at the end of the third recursive step on the first line we have:

First line: the luminance value of the white pixels is encoded in X X X X X X X 1 1 1; the remaining value to encode is 52;

First line: the luminance value of the black pixels is encoded in: X X X X X X X 0 0 0 the remaining value to encode is 0;

For the first line, the fourth recursive step corresponding to the encoding of the $7^{th}$ sub-field is then carried out. The white pixels will use the $7^{th}$ sub-field since $52\geqq46$. The effective luminance of this sub-field for the first line is equal to $29\cdot(1+(1-\frac{1}{2})\times0.25)=33$. So at the end of the fourth recursive step on the first line we have:

First line: the luminance value of the white pixels is encoded in X X X X X X 1 1 1 1; the remaining value to encode is 19;

First line: the luminance value of the black pixels is encoded in X X X X X X 0 0 0; the remaining value to encode is 0;

For the first line, the fifth recursive step corresponding to the encoding of the $6^{th}$ sub-field is then carried out. The white pixels will not use the $6^{th}$ sub-field since $19<27$. So, the load of this line for this sub-field will be equal to 0. So the effective luminance of this sub-field for the first line is equal to $19\cdot(1+(1-0)\times0.25)=24$. So at the end of the fifth recursive step on the first line we have:

First line: the luminance value of the white pixels is encoded in X X X X X 0 1 1 1 1; the remaining value to encode is 19;

First line: the luminance value of the black pixels is encoded in X X X X X 0 0 0 0 0; the remaining value to encode is 0;

For the first line, the sixth recursive step corresponding to the encoding of the $5^{th}$ sub-field is then carried out. The white pixels will use the $5^{th}$ sub-field since 19≧15. The effective luminance of this sub-field for the first line is equal to 12·(1+(1−½)×0.25)=14. So at the end of the sixth recursive step on the first line we have:

First line: the luminance value of the white pixels is encoded in: X X X X 1 0 1 1 1 1; the remaining value to encode is 5;

First line: the luminance value of the black pixels is encoded in X X X X 0 0 0 0 0 0; the remaining value to encode is 0;

The first line will not use the $4^{th}$ sub-field since its highest remaining value (5 which is the remaining value for the white pixels) is smaller than its switching value (8). So at the end of the seventh recursive step, we have First line: the luminance value of the white pixels is encoded in X X X 0 1 0 1 1 1 1; the remaining value to encode is 5;

First line: the luminance value of the black pixels is encoded in X X X 0 0 0 0 0 0 0; the remaining value to encode is 0;

For the first line, the eighth recursive step corresponding to the encoding of the $3^{th}$ sub-field is then carried out. The white pixels will use the $3^{rd}$ sub-field since 524. The luminance of this sub-field for the first line is equal to 4·(1+(1−½)×0.25)=4. So at the end of the eighth recursive step, we have First line: the luminance value of the white pixels is encoded in: X X 1 0 1 0 1 1 1 1; the remaining value to encode is 1;

First line, the luminance value of the black pixels is encoded in X X 0 0 0 0 0 0 0 0; the remaining value to encode is 0;

For the first line, the ninth recursive step corresponding to the encoding of the $2^{nd}$ sub-field is then carried out. The white pixels will not use the $2^{nd}$ sub-field. The luminance of this sub-field for the first line is equal to 2·(1+(1−0)×0.25)=2. So at the end of the ninth recursive step, we have First line, the luminance value of the white pixels is encoded in X 0 1 0 1 0 1 1 1 1; the remaining value to encode is 1;

First line, the luminance value of the black pixels is encoded in X 0 0 0 0 0 0 0 0 0; the remaining value to encode is 0;

Finally, the tenth recursive step corresponding to the encoding of the $1^{st}$ sub-field is then carried out. The white pixels will use the $1^{st}$ sub-field since 1≧1. So at the end of the tenth recursive step, we have First line, the luminance value of the white pixels is encoded in 1 0 1 0 1 0 1 1 1 1;

First line, the luminance value of the black pixels is encoded in 0 0 0 0 0 0 0 0 0 0.

The luminance value of the white pixels and black pixels of the other lines identical to the first line are encoded as defined for the first line.

For the middle lines, the first recursive step corresponding to the encoding of the $10^{th}$ sub-field is carried out as follows. The pixels (all of them are white) use the $10^{th}$ sub-field since 255≧176. The load of this line for this sub-field is equal to 1 since all pixels of this line use this sub-field. So the luminance of this sub-field for the middle lines is equal to the expected value 80·(1+(1−1)×0.25)=80. So at the end of the first recursive step, we have Middle line: the luminance value of the pixels is encoded in X X X X X X X X X 1; the remaining value to encode is 175;

At the end of the second recursive step (encoding of the $0^{th}$ subfield) of the middle line, since 175≧117, we have:

Middle line: the luminance value of the pixels is encoded in X X X X X X X X 1 1; the remaining value to encode is 116;

At the end of the third recursive step (encoding of the $8^{th}$ subfield) of the middle line, since 116≧75, we have:

Middle line: the luminance value of the pixels is encoded in X X X X X X X 1 1 1; the remaining value to encode is 74;

At the end of the fourth recursive step (encoding of the $7^{th}$ subfield) of the middle line, since 74≧46, we have:

Middle line: the luminance value of the pixels is encoded in X X X X X X 1 1 1 1; the remaining value to encode is 45;

At the end of the fifth recursive step (encoding of the $6^{th}$ subfield) of the middle line, since 45≧27, we have:

Middle line: the luminance value of the pixels is encoded in X X X X X 1 1 1 1 1; the remaining value to encode is 26;

At the end of the sixth recursive step (encoding of the $5^{th}$ subfield) of the middle line, since 26≧15, we have:

Middle line: the luminance value of the pixels is encoded in X X X X 1 1 1 1 1 1; the remaining value to encode is 14;

At the end of the seventh recursive step (encoding of the $4^{th}$ subfield) of the middle line, since 14≧8, we have:

Middle line: the luminance value of the pixels is encoded in X X X 1 1 1 1 1 1 1, the remaining value to encode is 7;

At the end of the eighth recursive step (encoding of the $3^{rd}$ subfield) of the middle line, since 7≧4, we have:

Middle line: the luminance value of the pixels is encoded in X X 1 1 1 1 1 1 1 1; the remaining value to encode is 3;

At the end of the ninth recursive step (encoding of the $2^{nd}$ subfield) of the middle line, since 3≧2, we have:

Middle line: the luminance value of the pixels is encoded in X 1 1 1 1 1 1 1 1 1; the remaining value to encode is 1;

At the end of the tenth recursive step (encoding of the $1^{st}$ subfield) of the middle line, since 1≧1, we have:

Middle line: the luminance value of the pixels is encoded in 1 1 1 1 1 1 1 1 1 1

So finally we get for the whole picture:

First line: the luminance value of the white pixels is encoded in 1 0 1 0 1 0 1 1 1 1

First line: the luminance value of the black pixels is encoded in 0 0 0 0 0 0 0 0 0 0

Middle line: the luminance value of the pixels is encoded in 1 1 1 1 1 1 1 1 1 1

Last line: the luminance value of the white pixels is encoded in 1 0 1 0 1 0 1 1 1 1

Last line: the luminance value of the black pixels is encoded in 0 0 0 0 0 0 0 0 0 0

It is possible to check that the load effect is not visible with this encoding. On the first and last lines, the white pixels have a sub-field weight sum of 227. But the used sub-fields have a load of 50% on these lines, so the luminance is equivalent to 227·(1+(1½)×0.25)=255. And on the middle lines, the white pixels have a sub-field weight sum of 255. But since the used sub-fields have a load of 100% on these lines, the luminance is equal to the expected luminance (255). So no line load will be visible.

Figure 4:
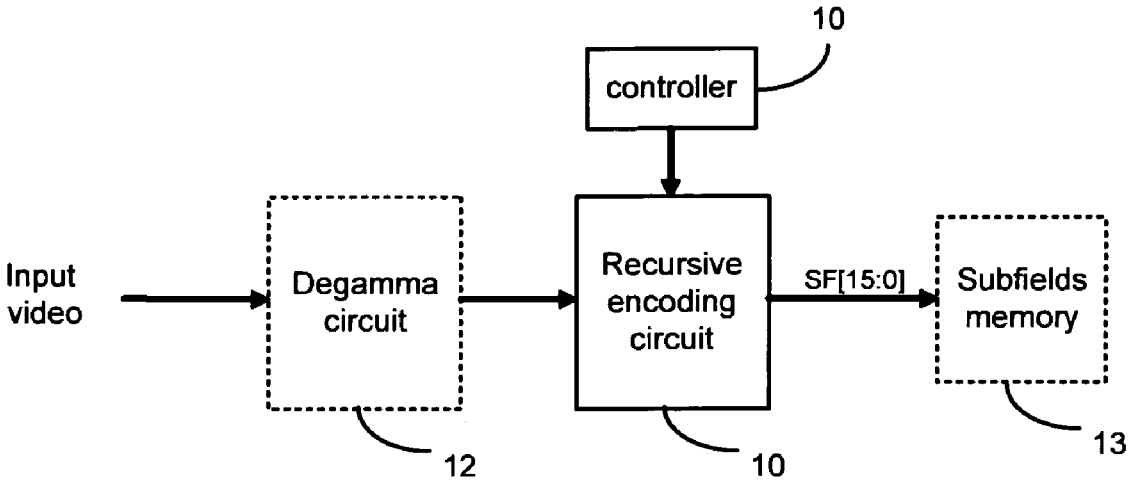
FIG. 4 is schematic diagram of a device implementing the inventive method.

A device for implementing the inventive method is shown at FIG. 4. This device comprises a recursive encoding circuit 10 and a controller 11 for controlling said circuit. The recursive encoding circuit 10 receives video coming from a degamma circuit 12 and outputs subfield code words SF[15:0] in a subfields memory 13. In the example of FIG. 4, the circuit 10 applies also a dithering function to the data coming from a degamma circuit 12.

Figure 5:
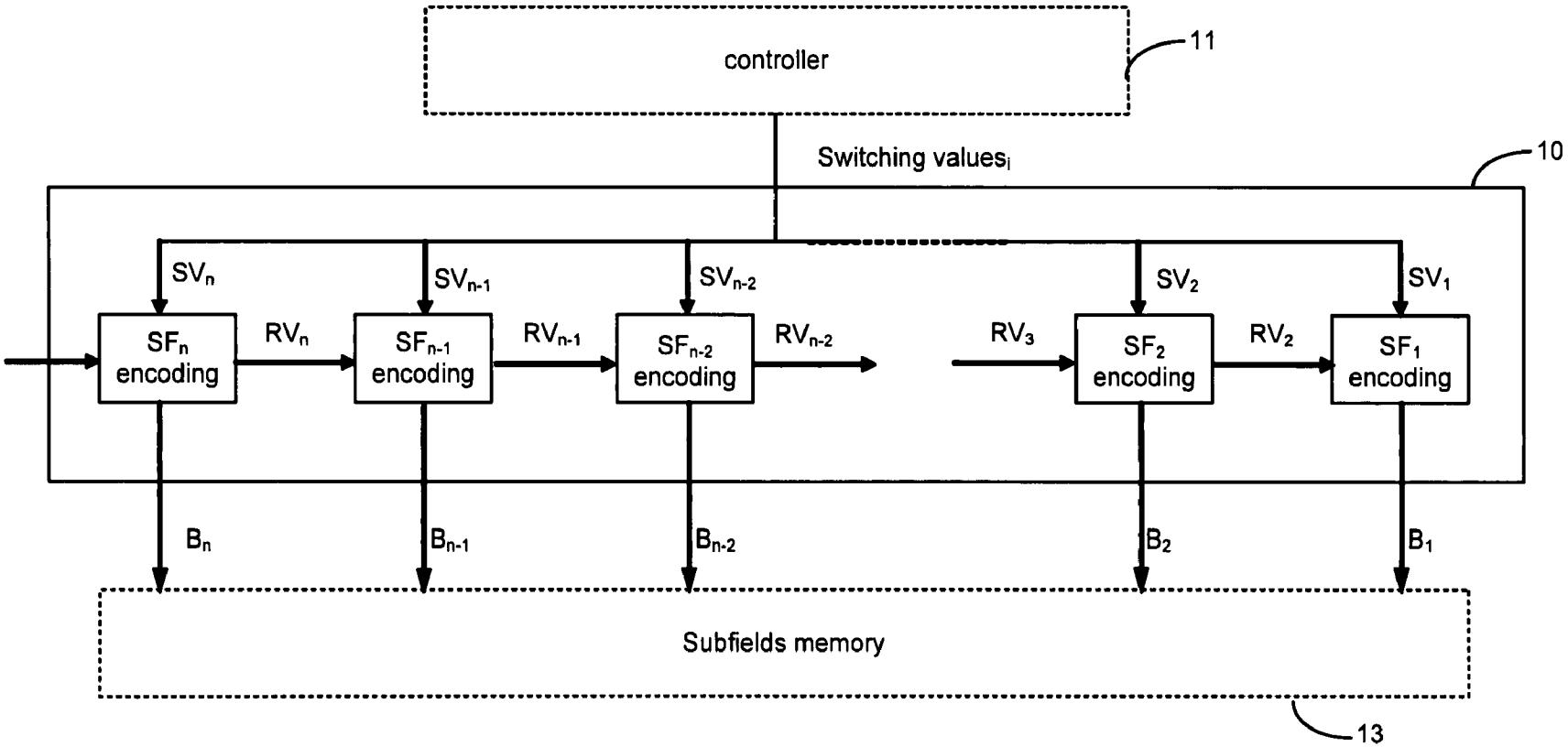
FIG. 5 is a more detailed schematic diagram of a device implementing the inventive method.

A schematic diagram of the recursive encoding circuit 10 is given at FIG. 5. It comprises n encoding blocks, one for each subfield (n being the number of subfield). In the following description, each subfield is denoted $SF_i$, i being the number of the subfield. $SF_n$ designates the subfield with the highest weight (also denoted most significant subfield) and $SF_1$ designates the subfield with the lowest weight (also denoted least significant subfield). Each encoding block receives from the controller 11 the switching value $SV_i$ associated to the subfield $SF_i$ that it encodes and a luminance value coming from the preceding encoding block or the degamma circuit and outputs a subfield code bit $B_i$ corresponding to the subfield $SF_i$ and a remaining luminance value $RV_i$ to be encoded by the following encoding blocks. The subfield code bit $B_i$ is stored in the subfields memory 13.

More particularly, the encoding block associated to the subfield $SF_n$ receives luminance value coming from the degamma circuit 12 and the switching value of the subfield $SF_n$ from the controller 11 and outputs a subfield code bit $B_n$ and the remaining luminance value $RV_n$ to be encoded by the following encoding blocks. The encoding block associated to the subfield $SF_i$, $i \in [2 \ldots n-1]$ receives the remaining luminance value $RV_i$ and the associated switching value $SV_i$ from the controller 11 and outputs the subfield code bit $B_i$ and the remaining luminance value $RV_i$ to be encoded by the following encoding blocks. The last encoding block associated to the subfield $SF_1$ receives the remaining luminance value $RV_2$ and the switching value $SV_1$ and outputs the subfield code bit $B_1$.

Figure 6:
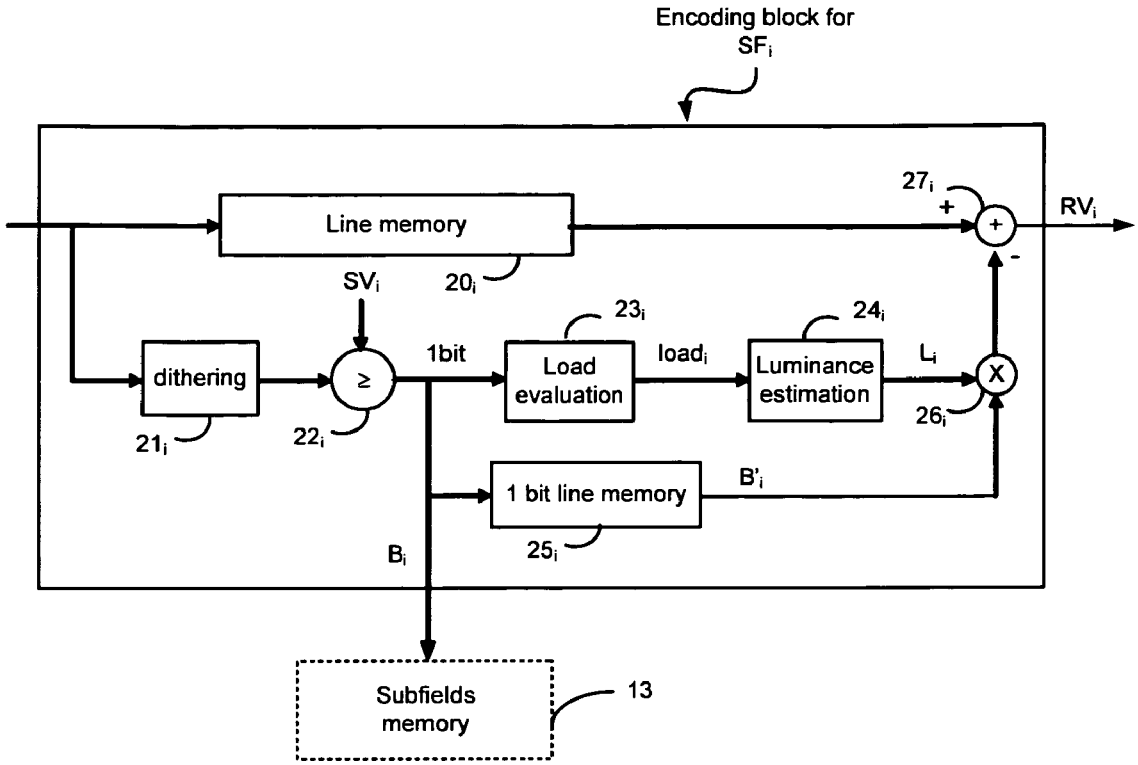
FIG. 6 is a schematic diagram of a first part of the device of FIG. 5 for generating the most significant bits of the subfield code word.

A possible schematic diagram of the encoding block associated to the subfield $SF_1$, $i \in [2 \ldots n]$, is shown at FIG. 6. It comprises:

- a line memory $\mathbf{20}_i$ for storing the luminance values for a line of pixels coming from the degamma circuit 12 for the subfield $SF_n$ and the remaining values $RV_i$ for the subfields $SF_i$ with $i \in [2 \ldots n-1]$;
- a dithering block $\mathbf{21}_i$ for applying a dithering function to said luminance values or remaining values $RV_i$,
- a comparison circuit $\mathbf{22}_i$ for comparing the dithered luminance values to the switching value $SV_i$ and outputting a bit $B_i$ to "1" when said dithered luminance values are equal to or greater than $SV_i$, the bit $B_i$ being the subfield code bit that is stored in the subfields memory 13,
- a load evaluation circuit $\mathbf{23}_i$ for computing the load $Load_i$ of the considered line for the subfield $SF_i$,
- a luminance estimation circuit $\mathbf{24}_i$ for estimating the effective luminance $L_i$ of the subfield $SF_i$ for the considered line of pixels on the basis on the load values $Load_i$,
- a one bit line memory $\mathbf{25}_i$ for delaying the bit $B_i$ of one line period, said delayed bit be denoted $B'_i$,
- a circuit $\mathbf{26}_i$ for multiplying the bit $B'_i$ and the effective luminance $L_i$;
- a circuit $\mathbf{27}_i$ for subtracting the output value of the multiplying circuit $\mathbf{26}_i$ from the luminance value stored in the line memory $\mathbf{20}_i$, the result value being the remaining value to be encoded by the following encoding blocks.

Figure 7:
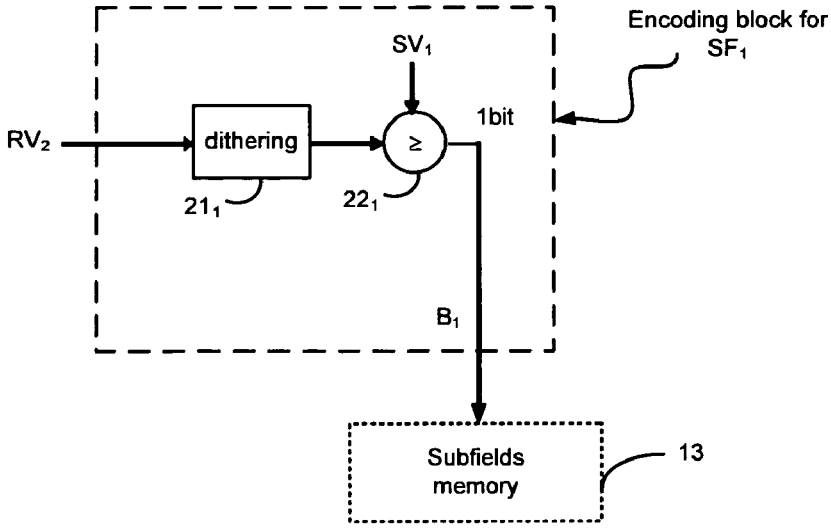
FIG. 7 is a schematic diagram of a second part of the device of FIG. 5 for generating the other bits of the subfield code word.

A possible schematic diagram of the encoding block associated to the subfield $SF_1$ is shown at FIG. 7. It comprises:

- a dithering block $\mathbf{21}_1$ for applying a dithering function to the remaining value $RV_2$, and
- a comparison circuit $\mathbf{22}_1$ for comparing the dithered luminance values to the switching value $SV_1$ and outputting a bit $B_1$ to "1" when said dithered luminance values are equal to or greater than $SV_1$, the bit $B_1$ being the subfield code bit that is stored in the subfields memory 13.

All these circuit diagrams are only given as examples of implementation. The different line memories of the device can be combined in one single memory. It can also comprise no dithering circuit.

The invention claimed is:

1. Method for encoding the luminance value of a pixel of a picture into a subfield code word in a display device, wherein each bit of the subfield code word has a state "ON" or "OFF" and generates a light emission during an own period called subfield when its state is "ON", the light emitted for a pixel by the pixel's subfield code word being representative of the luminance value of said pixel and the total duration of the subfields associated to the bits of the subfield code word forming the picture frame, each sub-field having a weight proportional to the subfield's duration, wherein the bits of each subfield code word are computed recursively one after the other from the bit associated to the subfield having the most significant weight to the bit associated to the subfield having the least significant weight, wherein for the bit associated to the subfield having the most significant weight, allocating a state "ON" to said bit if the luminance value of the current pixel is equal to or greater than a threshold value associated to said bit, and for each following bit of the subfield code word, computing a remaining luminance value to be encoded by said bit comprising calculating the number of bits having the bit associated with said preceding subfield being in a "ON" state in a line of pixels to which a current pixel belongs, estimating a subfield luminance value for said subfield on the basis of said number of pixels being in an "ON" state, subtracting the estimated subfield luminance value from the luminance value to be encoded and allocating a state "ON" to the bit if the remaining luminance value is equal to or greater than a threshold value associated with said bit, in order that no line load will be visible.

2. Method according to claim 1, wherein the threshold value associated to a bit is equal to the sum of the weights of the subfields having a lower weight than the weight of the subfield corresponding to said bit plus one.

3. Method according to claim 1, wherein the remaining luminance value to be encoded by a bit for a current pixel is computed as a function of the state of the pixels of the line of the display device to which the current pixel belongs.

4. Method according to claim 3, wherein the remaining luminance value to be encoded by a current bit of the subfield code word of a current pixel is computed by:

calculating, for the subfield, called preceding subfield, computed just before the subfield associated to said current bit, the number of pixels having the bit associated to said preceding subfield in a "ON" state in the line of pixels to which the current pixel belongs;

estimating a subfield luminance value for said subfield on the basis of said number of pixels, and subtracting said subfield luminance value from the luminance value to be encoded by the bit associated to said preceding subfield and the following bits of the subfield code word.

5. Device for encoding the luminance value of a pixel of a picture into a subfield code word in a display device, wherein each bit of the subfield code word has a state "ON" or "OFF" and generates light emission during an own period called subfield when its state is "ON", the light emitted for a pixel by its subfield code word being representative of the luminance value of said pixel and the total duration of the subfields associated to the bits of the subfield code word forming the picture frame, each sub-field having a weight proportional to its duration, wherein the bits of each subfield code word are computed recursively one after the other from the bit associated to the subfield having the most significant weight to the bit associated to the subfield having the least significant weight, wherein, for computing each bit of the subfield code word of a current pixel, it comprises:

a comparator circuit for allocating a state "ON" to the bit associated to the subfield having the most significant weight if the luminance value of the current pixel is equal to or greater than a threshold value associated to said bit, a calculation circuit for calculating the number of bits having the bit associated with a preceding subfield being in a "ON" state in the line of pixels to which the current pixel belongs, for estimating a subfield luminance value for said subfield on the basis of said number of pixels being in an "ON" state, for subtracting the estimated subfield luminance value from the luminance value to be encoded and to allocate the "ON" state to the bit if the remaining luminance value is equal to or greater than a threshold value associated with said bit, in order that no line load will be visible.

6. Device according to claim 5, wherein it further comprises a controller for outputting the threshold values associated to the different bits of the subfield code word.

7. Device according to claim 5, wherein the threshold value associated to a bit is equal to the sum of the weights of the subfields having a lower weight than the weight of the subfield corresponding to said bit plus one.

8. Device according to claim 5, wherein said calculation circuit calculates the remaining luminance value to be encoded by a bit for a current pixel as a function of the state of the pixels of the line of the display device to which the current pixel belongs.

9. Device according to claim 8, wherein the calculation circuit, for calculating the remaining luminance value to be encoded by a current bit of the subfield code word of a current pixel, comprises:

means for calculating, for the subfield, called preceding subfield, computed just before the subfield associated to said current bit, the number of pixels having the bit associated to said preceding subfield in a "ON" state in the line of pixels to which the current pixel belongs;

means for estimating a subfield luminance value for said subfield on the basis of said number of pixels, and means for subtracting said subfield luminance value from the luminance value to be encoded by the bit associated to said preceding subfield and the following bits of the subfield code word.

10. Display device wherein it comprises an encoding device as claimed in claims 5.

* * * * *